United States Patent [19]

Nguyen

[11] Patent Number: 4,785,731

[45] Date of Patent: Nov. 22, 1988

[54] BUNDLE COUNT VERIFIER

[75] Inventor: Nhac Nguyen, Oakton, Va.

[73] Assignee: American Newspaper Publishers Association, Reston, Va.

[21] Appl. No.: 100,862

[22] Filed: Sep. 25, 1987

[51] Int. Cl.[4] ..... B65B 13/20

[52] U.S. Cl. ..... 100/4; 100/8; 414/901; 414/907; 377/8; 364/563

[58] Field of Search ..... 377/8; 414/625, 901, 414/907; 100/3, 8; 364/563

[56] References Cited

U.S. PATENT DOCUMENTS

| | | | |
|---|---|---|---|
| 3,269,089 | 8/1966 | Heywood | 53/586 |
| 3,568,591 | 3/1971 | Dunlap | 100/4 |
| 3,712,186 | 1/1973 | Lulie et al. | 414/32 |
| 3,744,649 | 7/1973 | Ward, Jr. | 414/32 |
| 3,834,290 | 9/1974 | Nelson | 414/36 |
| 4,189,133 | 2/1980 | Arrasmith et al. | 271/215 |
| 4,295,643 | 10/1981 | de la Vega | 270/57 |
| 4,313,172 | 1/1982 | Baumans et al. | 364/563 |
| 4,417,351 | 11/1983 | Williamson et al. | 377/8 |
| 4,547,112 | 10/1985 | Steinhart | 414/31 |
| 4,558,859 | 12/1985 | Duke et al. | 271/200 |
| 4,707,843 | 11/1987 | McDonald et al. | 377/8 |
| 4,718,807 | 1/1988 | Baxter | 414/907 |

OTHER PUBLICATIONS

"Flexo Project Highlights Current ANPA Research", Presstime, Oct. 1986, pp. 61–62.

"Bundle Verifier to be Tested", Presstime, Jan. 1987, p. 63.

Gudmundson, "Transducers for Accurate Positioning", Mechanical Engineering, May 1985, pp. 34–39.

Miscellaneous Product Information, Product Data, Bulletin 1745, Oct. 1984.

*Primary Examiner*—John S. Heyman

*Attorney, Agent, or Firm*—Finnegan, Henderson, Farabow, Garrett & Dunner

[57] ABSTRACT

An apparatus and method according to the invention for determining respective deviations in the total number of signatures in each of a plurality of individual successive stacks from a given number of signatures having a ram for compressing the stacks of the signatures, a linear differential voltage transducer for measuring the relative heights of signature stacks by measuring distance that the ram travels, control apparatus comprised primarily of a programmable controller for processing the output of the transducer and optical detection means for monitoring the stack top for a sheet indicating that the stack has an odd count and disabling the control apparatus for indicating deviations in stack count. Additionally, a strapper which includes the apparatus for determining the count deviations adapted to monitor the position of a belt drive.

16 Claims, 8 Drawing Sheets

BUNDLE COUNT VERIFIER

BACKGROUND OF THE INVENTION

The present invention relates to a bundle count verifier and more particularly to an apparatus and method for determining the deviation in the total number of newspapers or other signatures in the stack from a given standard number.

A bundle count verifier is used in the newspaper industry to verify that the number of newspapers in a stack, which are to be made into a bundle by a strapping machine, has the correct number of newspapers. Before bundling a newspaper, the printed newspaper is folded and the different sections assembled. The final newspaper may have sections made from standard newsprint and a variety of inserts, such as magazine sections and the like printed on different stock paper.

The assembled newspaper is then stacked by a stacking apparatus. After being stacked, the newspapers are then strapped together into bundles. With the exception of designated odd-count bundles, bundles should all contain the same number of newspapers in order to facilitate efficient allocation of the newspapers to distributors. If bundles contain too many newspapers, these excess newspapers represent lost cash to the publisher. If too few newspapers are present in bundles then the distributors will not be able to complete their distribution. This is costly to the publisher since special deliveries have to be made to complete the distribution.

Due to the economies of scale which large publishers operate under, it has been proven economical to install bundle count verifiers to verify that the bundles leaving the stacking apparatus contain the correct number of newspapers. Failure to verify the bundle count while stacking can result in grievous economic consequences after just one run through a malfunctioning stacker.

The newspaper industry does use bundle count verifiers which rely on the weight of the stacks of newspaper. In this system, all stacks of newspapers which weigh the same are considered to have the same number of newspapers. However, due to variations in the newsprint itself, this often is not true. The characteristics of newsprint stock is not constant from one roll to the next and, consequently, the same number of newspapers may have two different weights. One inconsistency in newsprint which affects the weight is the difference in moisture content due to newsprint stock having variable ability to absorb the printing ink. Additionally, the weight may vary because the fibers present in different newsprint stocks may vary themselves (i.e., a variation in fiber density).

A bundle weigher must make thousands of accurate measurements a day in a commercial newspaper setting. Each one of the weight measurements made by the weigher must be highly accurate in order to avoid unnecessary shutdowns due to false indications or malfunctions. An apparatus able to withstand this prolonged wear and tear is expensive to fabricate and can still be susceptible to breakdown.

There are other industries which sell groups of signatures or other flat, stacked articles. For example, magazines, envelopes and sheet materials, are stacked and sold in bundles. These industries have the same motivations for using bundle count verifiers as cited in reference to the newspaper industry. However, alternative types of bundle count verifiers have been proposed which do not rely on the weight of the stack of signatures.

One type of bundle count verifier which has been proposed relies on simply the height of the stack to determine the number of stacked flat articles. One proposed apparatus for implementing this type of bundle count verifier counts the number of flat articles in the stack by positioning a platen onto a stack of corrugated sheets of paper. The platen is driven by a stepping motor. During the period in which the stepping motor is driving the platen, the counter counts. When the platen contacts the top of the stack of corrugated sheets of paper, a contact switch associated with the platen stops the counter and deactivates the stepping motor. This type of device is illustrated in the U.S. Pat. No. 4,417,351 to Williams et al.

It has also been proposed to count stacks of articles by measuring the height of the stacked articles by means of optical detection.

There are also certain inaccuracies associated with these concepts. Using a height measurement without sufficient compression force to verify or count the number of flat articles or signatures in the stack can result in inaccurate operation for certain types of flat articles such as newspapers. These inaccuracies arise because of the variable vertical compressibility of flat articles such as newspapers. When a single height measurement is taken of the stack, the variable compression of the individual articles in the stack cannot be taken into account. The variable compression of newspapers arises from differences in settling within the stack and differences in the way the newspaper is assembled.

Regardless of the disadvantages or advantages found in the bundle count verifiers of the prior art, they all represent investment into an entirely separate piece of machinery. This investment is significant to any business and particularly so to small businesses. In order to minimize investments into new apparatus it is often desirable to incorporate a new capability in an old apparatus.

Another restriction placed on the utilization of bundle count verifiers by small publishers are the small irregular orders which a small business must fill. Not all bundles may have the same number of newspapers. Consequently, it is necessary to provide a means for disabling the bundle count verifier when an odd count stack is being verified. Without this feature odd count bundles would indicate an error to bundle verifiers.

SUMMARY OF THE INVENTION

The principal object of the present invention is to provide an accurate low cost apparatus for verifying that the number of stacked signatures in a bundle is correct.

Another object of the invention is to provide a method by which the count of the number of signatures in a stack of signatures is accurate.

Still another object of the present invention, is to provide an apparatus with the foregoing advantages which may be installed in a pre-existing apparatus used to strap the stacks of signatures.

There is still another object of the present invention to provide a method and apparatus by which a bundle count can be verified without introduction of inaccuracies due to weight differences in the paper or compressibility of the volume of the signatures.

Still another object of the present invention is to provide an apparatus and method for verifying the number of newspapers in a stack dependant on the more strictly controlled thickness of the newspaper.

A further object of the present invention is to provide a bundle count verifier which is economical and useful to small concerns with irregular orders.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention as embodied and broadly described herein, as an apparatus for determining respective deviations in the total number of signatures in each of a plurality of individual successive stacks from a given number of signatures, comprises means for compressing a plurality of individual stacks of signatures including a standard stack having said given number of signatures in succession to a predetermined pressure, means for detecting variations between the height of said compressed standard stack and the height of each individual successive compressed stack and means responsive to the detected variations for indicating a number of signatures in each of said successive stacks different from said standard stack.

In another aspect and as embodied and broadly described herein, the invention provides a method of determining a deviation in the total number of signatures in a stack from a given number of signatures comprises the steps of stacking a given number of the signatures in a standard stack having the given number of signatures, compressing the standard stack to a predetermined pressure, measuring the height of the compressed standard stack, compressing a next stack of the signatures to the predetermined pressure and detecting the deviation from the given number of signatures in the standard stack as a function of the height of said next stack relative to the height of the standard stack.

In still another aspect of the invention, as embodied and broadly described herein, an apparatus for strapping a stack of signatures in accordance with the present invention comprises a ram for compressing a plurality of individual stacks of signatures in succession to a predetermined pressure, a cable drive operatively coupled to said ram for operating said ram, strapping means for fixedly securing the signatures in each of the plurality of compressed stacks of signatures, and means responsive to the position of said cable drive for determining respective deviations in the total number of signatures in each of said plurality of individual successive stacks from a given number of signatures.

The accompanying drawings, which are incorporated in and constitute a part of the specification, illustrate one embodiment of the invention, together with the description, serve to explain the principles of the invention.

DESCRIPTION OF THE PREFERRED EMBODIMENT

Reference will now be made in detail to the present preferred embodiment of the invention, an example of which is illustrated in the accompanying drawings.

Figure 1:
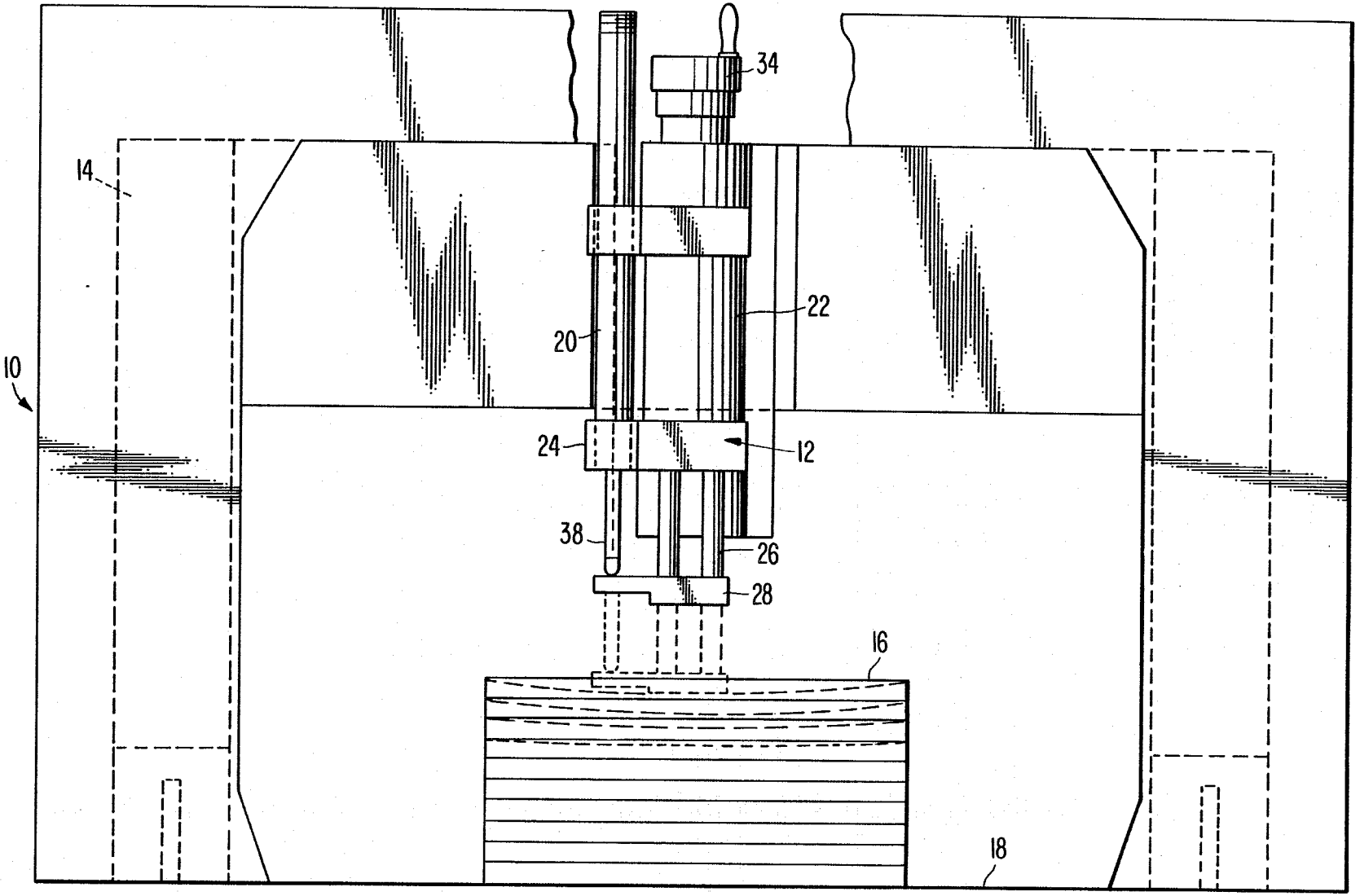
FIG. 1 is a front view of an apparatus according to a first embodiment of the present invention with a cutaway along the top.

A first preferred embodiment of the bundle count verifier is shown in FIG. 1 and is represented generally by the numeral 10. The bundle count verifier of the invention is described as an apparatus for determining respective deviations in the total number of signatures in each of a plurality of individual successive stacks from a given number of signatures. This apparatus, according to the invention, includes means for compressing a plurality of individual stacks of signatures including a standard stack having a given number of signatures in succession to a predetermined pressure. As embodied herein, the compressing means includes a ram assembly 12 supported by inverted U-shaped frame 14. Each stack of signatures 16, such as newspapers or magazines, for example, is positioned in succession on work surface 18 underneath ram assembly 12 during operation of the bundle count verifier. Preferably, the ram assembly 12 is suspended over the center of the top of stack 16 during normal operation. Work surface 18 is typically a conveyor belt for automatically conveying and positioning the stacks 16 in succession.

Figure 2:
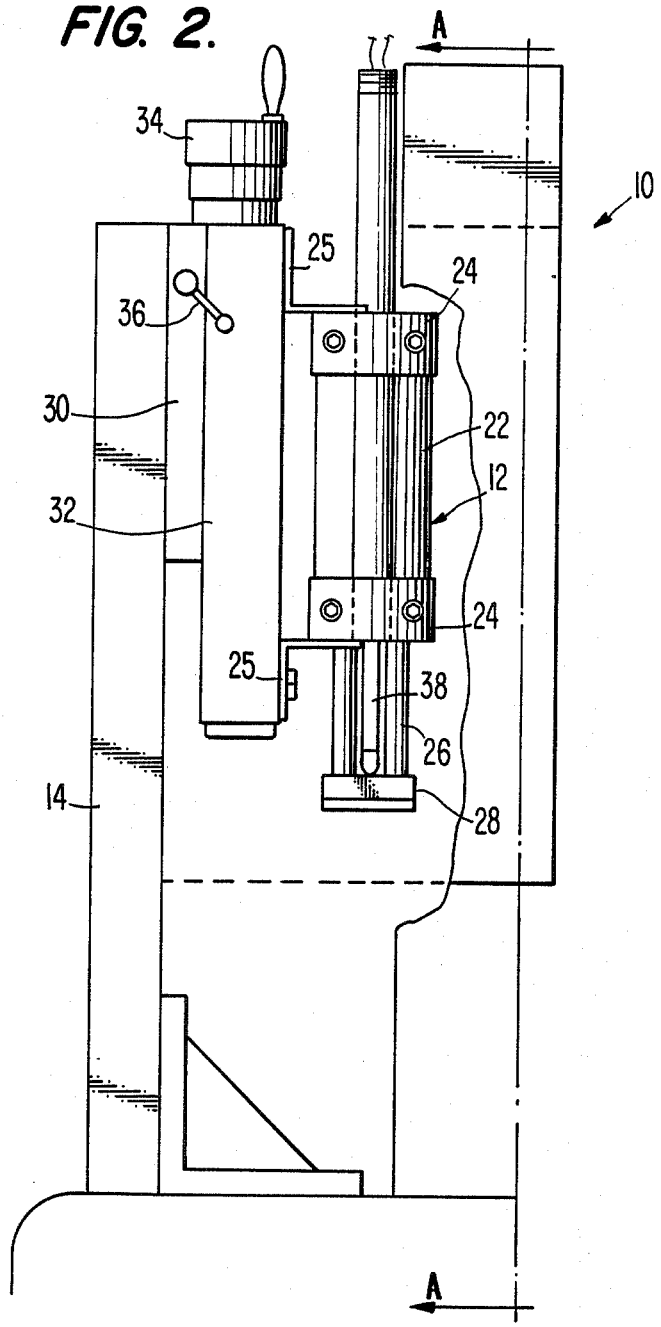
FIG. 2 is a side view of the apparatus of FIG. 1 with a cutaway.

Referring now to FIGS. 1 and 2, slide 30 is mounted on the vertical face of the horizontal cross piece of inverted U-shaped frame 14. The ram assembly 12 is slidably held in slide 30 by mounting base 32 which slides within slide 30 in a direction perpendicular to work surface 18. A threaded shaft and nut of conventional construction engages slide 30 and mounting base 32 to vertically position mounting base 32 along slide 30. Adjustment knob 34 is fastened to the threaded shaft for control of the positioning of mounting base 32 along slide 30. Locking lever 36 is attached to slide 30 for locking mounting base 32 in position.

Cylinder 22 is attached to mounting base 32 by mounting brackets 25 attached to mounting base 32 and extending out therefrom. The mounting brackets 25 are attached to the cylinder end blocks 24 with bolts. Preferably, cylinder 22 is a non-rotating pneumatic cylinder which drives ram 26 which consists of compression rods. In operation ram end 28 is driven down onto the stack of signatures 16 on work surface 18 as illustrated in phantom in FIG. 1.

In accordance with the invention, there are provided means for detecting variations between the height of the compressed standard stack and the height of each individual successive compressed stack. As embodied herein, the detection means includes a transducer 20 attached to and movable with ram assembly 12. Transducer 20 is connected to cylinder end blocks 24 with bolts. Extension shaft 38, which is movable relative to transducer 20, extends out from transducer 20 and is attached to ram end 28.

The transducer 20 is preferably a linear voltage differential transducer (LVDT) which produces a voltage output directly proportional to a position change. LVDT's are well known and are readily available an example of which is manufactured by Schaevitz Engineering.

Figure 3:
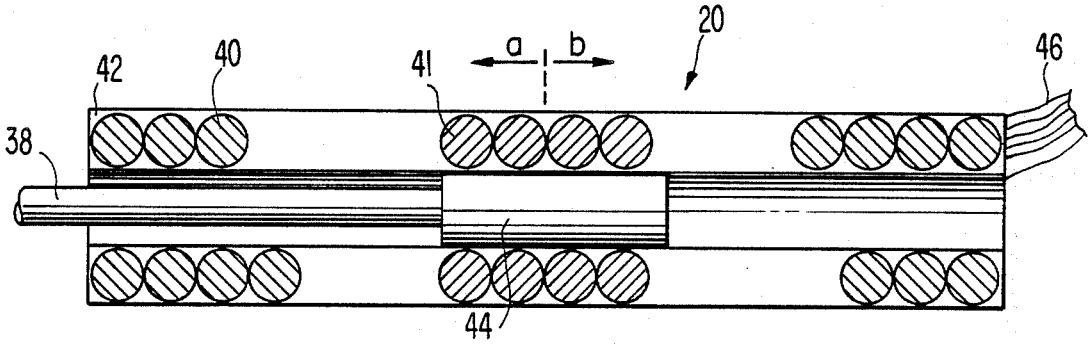
FIG. 3 is a longitudinal cross-sectional view of the transducer of FIGS. 1 and 2.

Referring now to FIG. 3, which is a longitudinal cross-sectional view of transducer 20 as used in the invention. Core 44 is slidably positioned within the cylindrical interior of tubular housing 42. A coil 40 is encased in tubular housing 42 surrounding core 44. Extension shaft 38 is connected to core 44.

The operation of transducer 20 is based on the inductive coupling between the core 44 and the coils 40 and 41. It is understood by those of ordinary skill in the art, movement of the core 44 from a central position within the coils 40 and 41 in either direction A or B will result in a differential voltage output from the transducer 20. Movement of ram end 28 results in corresponding movement of core 44 within coils 40 and 41 thereby producing a voltage output. The voltage output is transmitted along line 46 to detection and control apparatus which will be described hereinafter.

In accordance with the invention, there are provided means responsive to the detected variations for indicating a number of signatures in each of said successive stacks different from said standard stack. As embodied herein, the means responsive to the detected variations include coil 40 and 41 working in cooperation with the control circuitry illustrated in the schematic diagram of FIG. 7 as described hereinafter.

A second preferred embodiment of the invention is directed toward an apparatus for strapping a stack of flat articles. In accordance with the invention, the strapping machine has strapping means for fixedly securing the stacked articles in each of said plurality of stacks of flat articles. Preferably, the strapping means is a strapping apparatus 100 conventionally known in the art, and in such apparatus, the stack is secured by a strap 101 which is pulled all the way around the center of stack 16 by the strapper 102. Once the strap has been wrapped around the bundle, the strap is cut and the ends fastened together frictionally. An example of a typical strapping apparatus 100 which may be utilized in the second preferred embodiment is a model ML2-EE manufactured by Signode.

In accordance with the invention, there is a ram for compressing a plurality of individual stacks of signatures in succession to a predetermined pressure and a cable drive operatively coupled to said ram for operating said ram. As embodied herein and illustrated in FIGS. 4 and 5, ram 104 compresses stacks of signatures 16 when driven by drive belt 108. Strapping apparatus 100 extends over the work surface 18 and is shaped like the inverted U-shaped frame of the first preferred embodiment. Pulleys 109 guide drive cable 108 around the corners of the strapping apparatus 100 over work surface 18. Drive belt 108 has two ends which are anchored at belt end anchors 119 and 120. The driving force is supplied to drive belt 108 by cylinder 107 by movement of the pulley 109A by the piston of cylinder 107. The drive cable 108 may comprise such equivalents as would be well known in the art such as a chain, belt, for example.

Further according to the invention, ram 104 is comprised of a vertically movable horizontal bar that is supported at opposite ends thereof. Ram 104 is slidably mounted within the strapping machine 100. At the ends of ram 104 are provided rollers 105 which guide drive cable 108 through ram 104. Drive cable 108 extends through ram 104 and across rollers 105. When the cylinder 107 moves pulley 109A, drive cable 108 moves relative to belt end anchors 119 and 120 and in turn moves ram 104.

Figure 5:
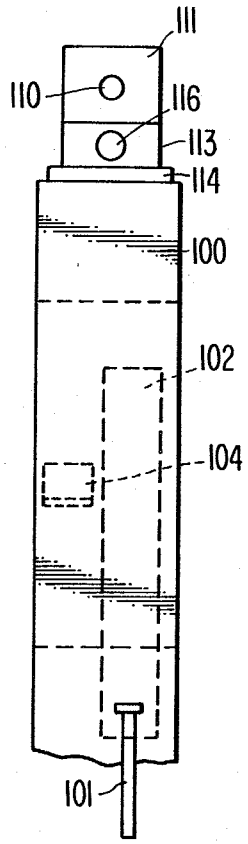
FIG. 5 is a fragmentary side view of the apparatus of FIG. 4.
Figure 4:
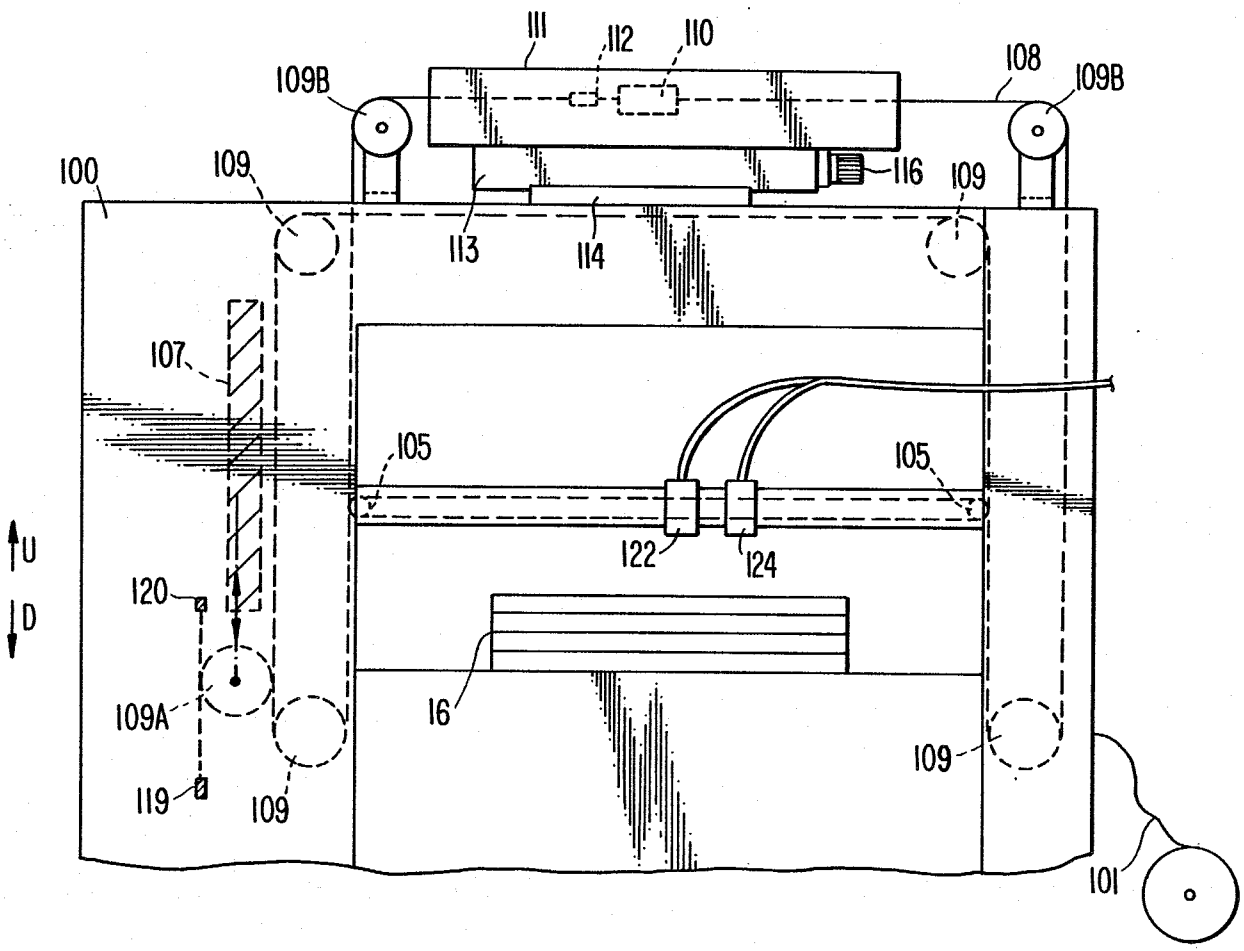
FIG. 4 is a fragmentary view of the strapping machine incorporated in the transducer of the present invention in accordance with a second embodiment thereof.

In accordance with the invention, the second preferred embodiment includes means responsive to the position of said cable drive for determining respective deviations in the total number of signatures in each of said plurality of individual successive stacks from a given number of signature stacks. As shown in FIGS. 4 and 5, the apparatus for determining the stack count deviations comprises the transducer assembly 106 mounted at the top of strapping machine 100, and includes the control apparatus illustrated in FIG. 7.

Figure 6:
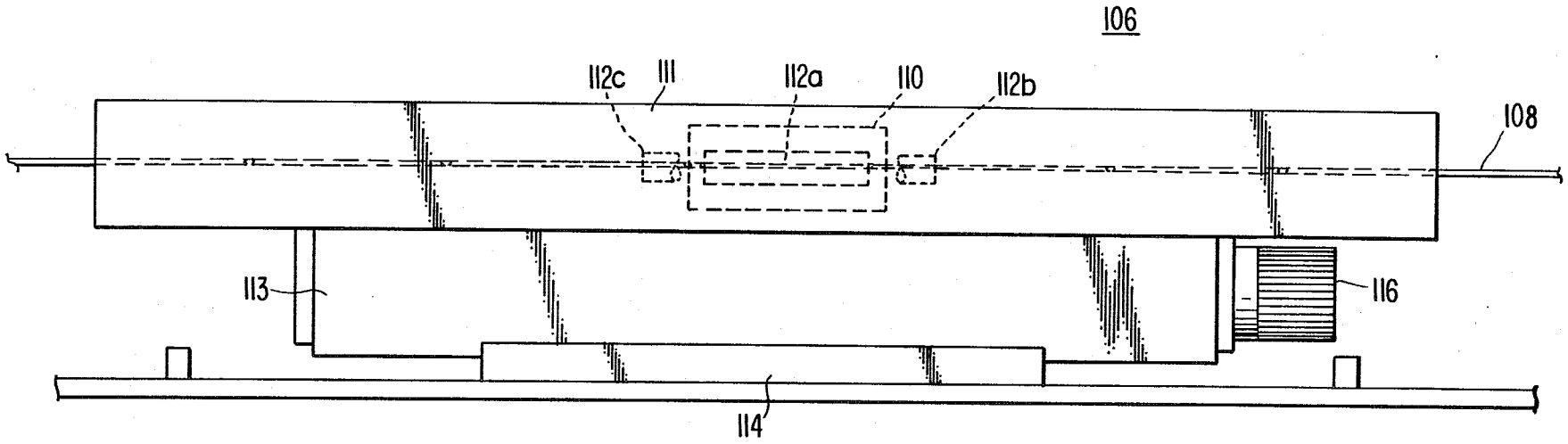
FIG. 6 is a magnified view of the transducer assembly of the apparatus of FIGS. 4 and 5.

Transducer assembly 106 is illustrated in FIGS. 4 through 6. Referring to FIGS. 4 and 5, transducer assembly 106 is comprised of transducer 110 mounting supports 111 transducer core 112 mounting base 113, slide 114, threaded shaft adjust 116 and cable guides 118. Mounting base 113 is slideably connected to slide 114 which is fixed to the top of strapping apparatus 100. Transducer 110 is attached to mounting base 113 via mounting support 111 mounted on top of mounting base 113 and encasing transducer 110 and core 112. Pulleys 109B are located on the top plate of machine 100 and are mounted in-line with the cable system of machine 100. Height of pulley 109B are adjusted to allow free movement of core 112 within transducer 110. Transducer 110 may be of the same type that was used in the first preferred embodiment of the invention. Instead of an extension shaft for moving core 112, the core 112 is moved by cable drive 108.

Core 112 is attached to cable drive 108 at each of its longitudinal ends. A section of the belt drive is removed and each end thereof is attached to the core 112. With the transducer assembly 106 installed, instead of a straight run of the belt over the top of strapping apparatus 100, the cable goes over the cable guides 118 and then into transducer 110 where it is connected to core 112.

In operation, the cable drive 108 drives ram 104 down onto stack 16. While cable drive 108 is driving ram 104 the cable position changes result in a directly proportionate changes the position of core 112.

In accordance with the invention, transducer 110 produces an output representative of a magnitude of said change in position. Preferably, the output of transducer 110 is characterized by the movement of core 112 from its central or null position as described with reference to transducer 20 in the first preferred embodiment. FIG. 6 illustrates the relevant portions of transducer assembly 106. In FIG. 12, 112A, 112B and 112C illustrate changes in position of core 112. The null position is located at 112A. By means that are known to those of ordinary skill in the art transducer 110 produces an output proportional to the change in position of the core.

Positions 112B and 112C which are partial representations of core 112's position during compression of stacks which have numbers of signatures which do not correspond to the number of signatures in the first stack. The central position of an LVDT transducer is the calibration point from which all position changes are measured. Referring to FIGS. 4 and 6, when pulley 109A is moved in the direction of arrow d, ram 104 will move in the direction of arrow u and the core 112 will move toward position 112B. When pulley 109A is moved in the direction of arrow u, ram 104 will move in the direction of arrow d and the core 112 move in the direction of position 112C. Therefore, position 112B represents the position of core 112 when a stack of signatures 16 with too many signatures is compressed by ram 104 and position 112C is core 112's position during compression of a stack with less than the standard number of signatures for a bundle.

As referred to previously, in accordance with the invention, there are means responsive to the detected variations for indicating a number of signatures in each of said successive stacks different from said standard stack. As embodied herein the control apparatus discussed with reference to the control circuit of FIG. 7 and the first preferred embodiment encompass means for carrying out the indication that a deviation in count of a stack has occurred.

The method of determining a deviation in the total number of signatures in a stack from a first number of signatures, according to the invention, includes the step of stacking a predetermined number of the signatures in a standard stack having said given number of signatures. In the preferred embodiment of the invention, this step may be carried out by means, known to those of ordinary skill in the art, for stacking stacks of articles. These stacks are intended to have the correct number of articles as counted by the stacker.

The next step of the invention is measuring the height of the compressed first stack. As embodied herein, this step is carried out by means of a ram 26 or 104 compressing the stack of articles. In the first embodiment, cylinder 22 exerts a driving force on ram 26 so that ram 26 extends down to the standard stack. Ram end 28 then contacts the top of the standard stack and applies a predetermined constant compressive force to the top of the standard stack.

In the second embodiment, cylinder 107 exerts the driving force via cable belt 108 on ram 104 so ram 104 is driven down onto the standard stack with a predetermined constant compressive force. The standard stack is considered to be a standard by which all subsequent stacks will be judged against. Therefore, the standard stack has a known count which is known to be correct.

After the first stack is compressed, according to the invention, the next step is measuring the height of the compressed first stack. Preferably, this measurement comprises calibrating the bundle count verifier so that the core 44 or 112 is positioned in the center of transducer 20 or 110 and the voltage output equals zero.

In the first preferred embodiment of the invention, setting the core 44 to the center of coil 40 at the point when the first stack of known number of articles is compressed is accomplished by adjusting the position of ram assembly 12. Ram assembly 12 is adjusted by turning threaded shaft adjustment knob 34 so that the threaded shaft and nut mechanism will move mounting base 32 relative to slide 30.

The first bundle is positioned under the center of ram end 28. Cylinder 22 then drives ram 26 with a precisely controlled constant pressure. After ram end 28 has contacted and fully compressed the first stack, the ram assembly is adjusted so that extension shaft 38 is extended to the point where attached core 44 is centered along the length of the cylindrical interior of transducer 20. Ram assembly adjustments change the distance the ram 26 must extend from cylinder 22 to fully compress a stack of flat articles. Since all subsequent measurements of the deviation in count of subsequent stacks will be made relative to the calibration position, mounting base 32 should now be locked in position relative to slide 30 with locking lever 36.

In the second preferred embodiment, as discussed with regard to the first embodiment, during compression of the first stack or standard stack the transducer is positioned so the core will be located at the central point along the length of transducer 110. The positioning of transducer 110 is accomplished by adjusting the position of transducer assembly 106. This operation parallels the calibration performed in the operation method discussed with respect to the first embodiment wherein ram assembly 12 was positioned.

Transducer assembly 106 is mounted on slide 114. Adjustments of the transducer assembly along the length of slide 114 are made by utilization of a conventional threaded shaft and nut mechanism adjustment knob 116 is turned to actuate the threaded shaft and nut assembly for positioning of transducer assembly 106.

Preferably, the compressive means of the preferred embodiments operate at a constant pressure which should be precisely controlled. In general, sufficient compression of the signatures alleviates errors in count verification due to the compressibilty of the volume of the signatures. The greater the pressure applied to a stack of signatures that is being compressed, the less the error introduced due to the volume of the signatures will be. Accordingly, the pressure at which the stacks are compressed should be as light as possible.

In accordance with the invention, the next step in determining a deviation in the total number of signatures in a stack from a given number of signatures is compressing a next stack of signatures to the predetermined pressure. As embodied herein, this step required the standard stack be moved out of position under arm ram 26 or 104 on work surface 18 and the next stack be placed on work surface 18 underneath ram 26 or 104. Once the next stack is in position the cylinder 22 or 107 will drive ram 26 or 104 with a precisely controlled constant pressure until ram end 28 or ram 104 contacts the second stack and fully compresses it. In the first embodiment, since extension shaft 38 is attached to ram end 28, at full compression of the next stack the core 44 will also have been repositioned within transducer 20. In like manner, core 112 will be repositioned within transducer 110 by drive cable 108.

Accordingly, the next step will be detecting the deviation from the given number of signatures in the standard stack as a function of the height of said next stack relative to the height of the standard stack. As embodied herein, the detection of the deviation of the given number of articles is done by detecting how far the core 44 or 112 of the transducer 20 or 110 is from its center position within coil 40. The repositioned core will inductively interact with the coil 40 if it is not at the central position determined by compression of the standard stack. If the next stack has the same number of signatures as the first stack, then the repositioned core will be located at the central position set during compression of the standard stack. Due to the compression of the first and second stacks compressed by ram 26 or 104, the variation in height measured by the transducer 20 or 110 will be a measure of the deviation in the number of articles between the standard and next stacks because the height will be directly proportional to paper thicknesses in the signatures during compression.

Movement of the core 44 or 112 from its center position within the coil 40 produces a output voltage linearly proportional to the amount of movement of the core within the coil. This production of a voltage corresponding to the amount of displacement of the core 44 is known to those of ordinary skill in the art.

In order to realize the utilization of the present invention in a large scale commercial setting and in accordance with the invention, there are the additional steps of compressing each stack in a plurality of successive stacks of the signatures to the predetermined pressure and detecting each deviation from the given number of articles in the standard stack as a function of the height of each stack in said plurality of successive stacks relative to the height of the standard stack, respectively. As embodied herein, these steps simply extend the steps discussed with reference to the next stack to a third or fourth or a plurality of successive stacks as would be necessary for a commercial apparatus.

In accordance with the invention, after detecting each deviation the step of counting each deviation is performed. As embodied herein, this step is performed by a counter internal to the programmable controller after a count error indication has been activated. In the preferred embodiments, this error indication is referred to as LO/HI indicator 78.

In accordance with the invention, the next step which may be taken is comparing the counted deviations and indicating a malfunction in response to said deviation count exceeding a predetermined count. Preferably, to indicate an error LO/HI indicator 78 would be activated which would in turn activate relay 60 and energize indicator bulb 68. The number of errors in article counts as reported by transducer 20 are counted by an internal counters in the programmable controller 70. When an error occurs and the number of errors exceeds a predetermined value a malfunction is indicated and the controller system will shut down and can only be reactivated through activation of manual start button 79. A malfunction which is detected may be indicative of the article stacker breaking down or the sensors of the bundle count verifier being out of calibration.

Figure 7:
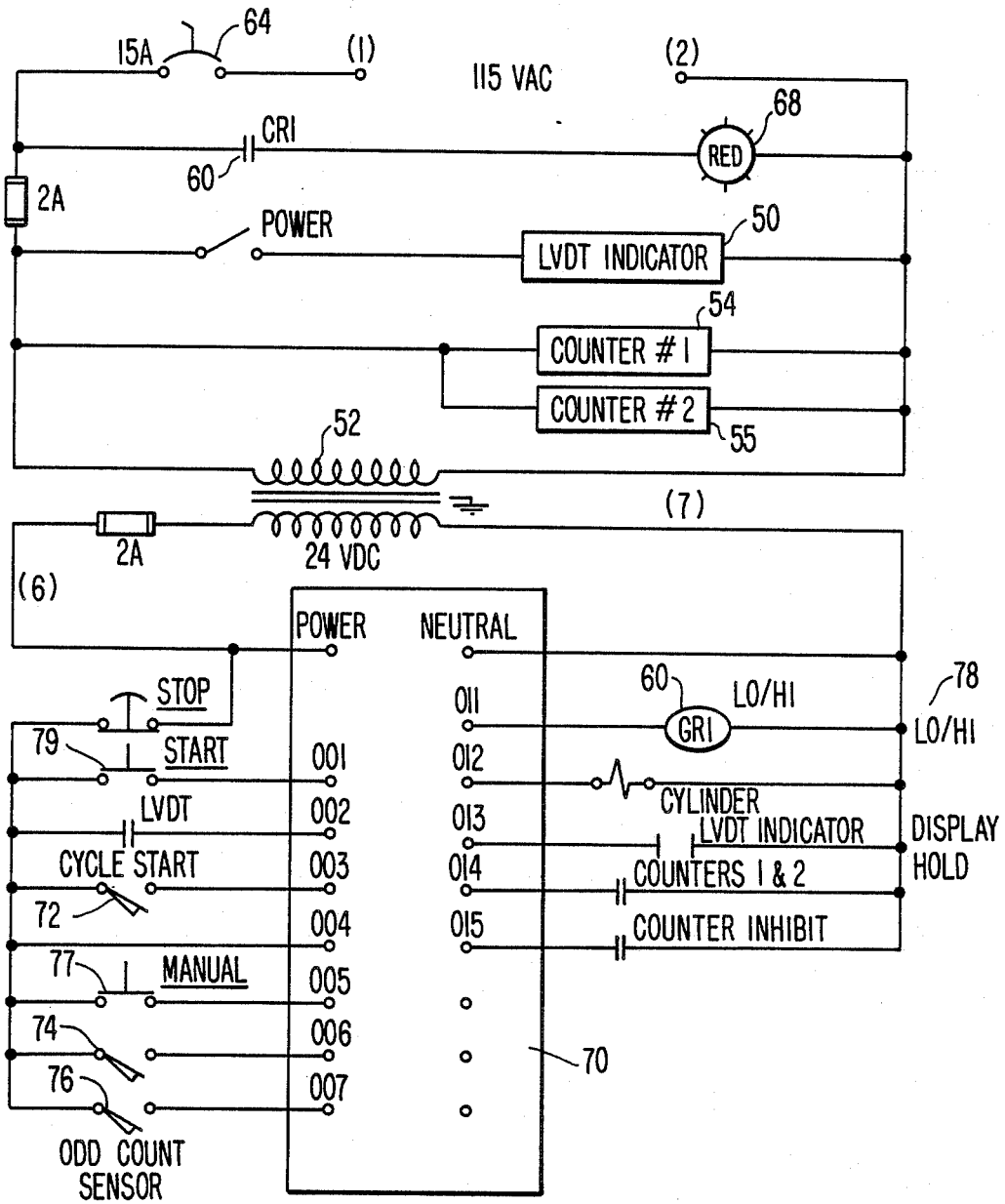
FIG. 7 is a circuit diagram of the control circuitry of the apparatus of FIG. 1.

FIG. 7 is a circuit diagram of the components of the control circuitry for the invention. The control circuit of the invention is powered by a standard 115 volt AC power source. Immediately out from the power source is a circuit breaker 64. Relay 60 controls the power to indicator bulb 68. The LVDT indicator 50 is part of a signal conditioner for the output of the transducers 20 or 110. The power is supplied to programmable controller 70 via a 24 volt DC converter. The programmable controller 70 controls all functions of the invention. The operation of such controllers is known to those of ordinary skill in the art and an example of such programmable controllers is a SLC 100 programmable controller made by Allen-Bradley.

Controller 70 has seven inputs. These inputs are assigned values within the controller. Input value 001 corresponds to a start button. Input value 002 is active when LVTD indicator 50 detects a output voltage from transducer 20 or 110 which exceeds a predetermined threshold. Input 003 becomes active when a stack of signature is positioned under the ram end 28 or 104. Input value 004 is normally active due to the normally on push button switch. Input value 005 initiates a manual cycle of the programmable controller 70 bypassing input 003 which activates the automatic cycle. Input values 006 and 007 are activated when the optical odd count sensors detect an odd count bundle as will be described hereinafter.

There are five outputs from controller 70 which have values between 01 and 015. Output value 011 activates relay 60 to turn on indicator bulb 68. Output value 012 is intended to activate the cylinder 22 or 107 for commencement of a compression cycle. This capability of controlling cylinder 22 is necessary in the first preferred embodiment but not in the second preferred embodiment since the actuation of cylinder 107 is normally automatic. Output value 013 serves a display hold function to freeze the digital display on the LVDT signal conditioner. Counters 54 and 55 are controlled by activation of output values 014 and 015.

Figure 8A:
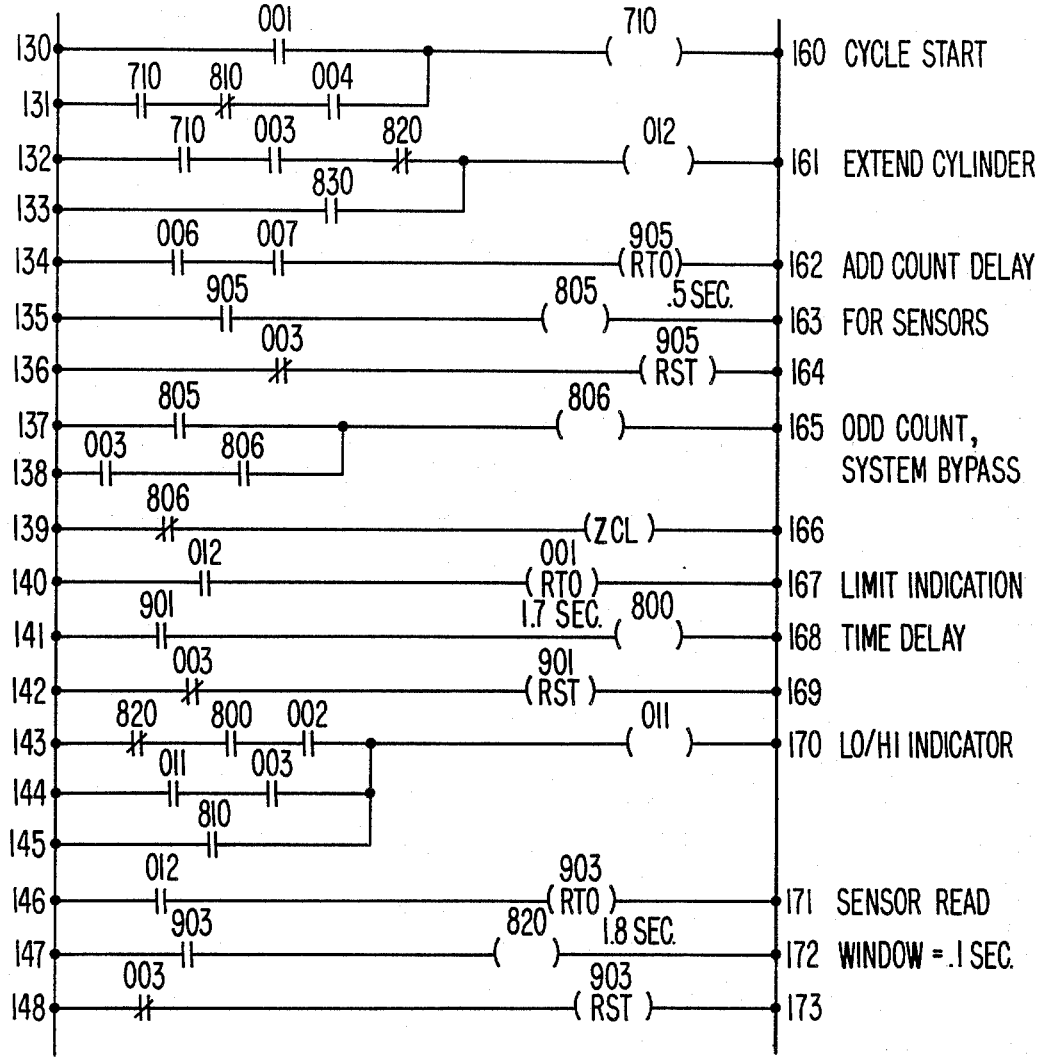
FIGS. 8A and 8B when placed vertically one on the other represents a ladder diagram of the programming sequence for the programmable controller of FIG. 7.
Figure 8B:
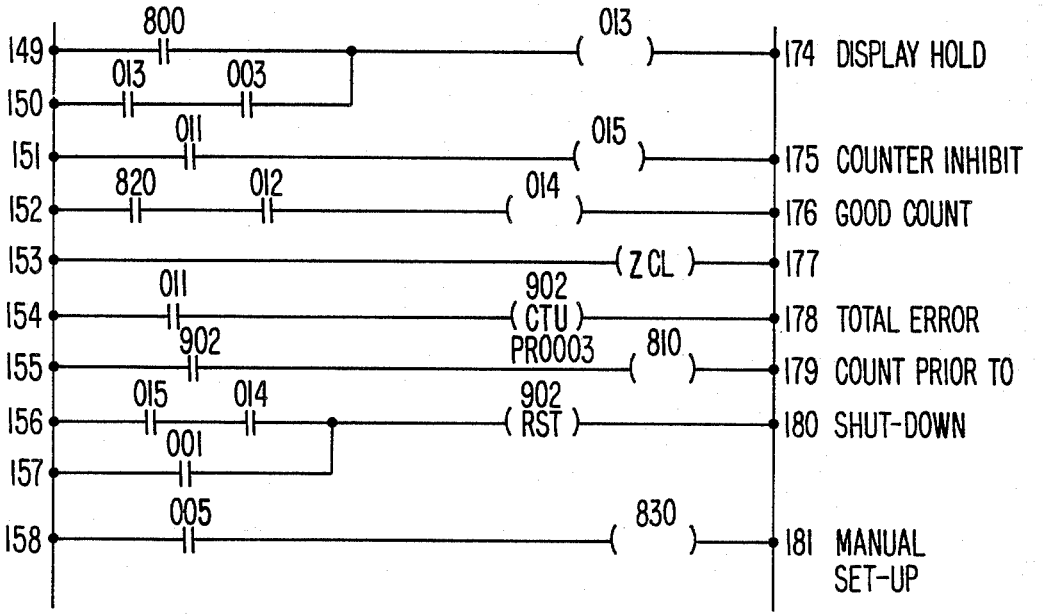

The operation of controller 70 is conventionally described in a ladder diagram. The specific ladder diagram for operation of the invention is illustrated in FIGS. 8A and 8B. On the left hand side of the ladder diagram of FIGS. 8A and 8B, reference numerals 130 to 157 designate the input value sequences necessary to generate the output values indicated on the right of FIGS. 8A and 8B and referred to by reference numerals 160 to 180. The values may be internal values, external inputs or external outputs.

The first rung of the ladder diagram is comprised of the input sequences 130 and 131 and output sequence 160. Referring to the first input sequence 130, activation of external input value 001 by depression of a start button will result in output sequence consisting of the value 710 which is indicative of a controller 70 cycle start. Input sequence 130 is comprised of the activation of external input of value 001. Input sequence 131 is comprised of the internal value 710 being activated, value 810 being inactivated and the external input with value 004 being activated. This rung further comprises the output sequence 160 which has an active value of 710 if either of the two input sequences 130 or 131 are true. The second input sequence 131 which can produce output sequence 160 is affectively a means for latching in the cycle start value 710. Input sequence 131 latches in output sequence 160 because value 710 will regenerate itself as long as value 810, which is indicative of an error, is not activated and the normally activated external input 004 remains activated.

Once the controller 70 has begun its cycle as indicated by value 710, input sequence 132 will be realized if the input value 003 is activated, indicating that a cycle of compression has begun, value 820 is not active and value 710 is active as described before. Input sequence 132 will result in output sequence 161. For both preferred embodiments the cycle start switch 72, or input value 003, is activated by the presence of a stack of signature underneath ram 28 or 104. The output sequence 161 is the activation of external output 012 which will control the cylinder 22 or 107 if necessary. Although, in the second preferred embodiment the strapping apparatus 100 operates independently of outside controls therefore activation of value 012 serves to initiate additional steps in a normal sequence of operations. External output 012 is also activated if internal value 830 is activated. Internal value 830 is activated by activation of manual switch 77 as shown in input sequence 158 and output sequence 181. Input sequence 140 which consists of external output value 012 generates output sequence 167 which is designated as value 901 and causes a time delay which corresponds to the time for the stack of signatures currently being compressed to be fully compressed. After the time delay of output sequence 167, value 901 becomes active. As shown in input sequence 141 and output sequence 168, the activation of value 901 results in the activation of internal value 800. As further shown in input sequence 142 and output sequence 169, value 901 will remain active as long as the cycle start external input 003 does not become inactive.

External output value 012 also activates an additional delay longer than the previous delay. The additional delay provides a window of time in which the output of the transducer is to be read by the LVDT signal conditioner. As shown in the rung of the ladder diagram consisting of input sequence 146 and output sequence 171 external output value 012 initiates a delay and after the delay internal value 903 becomes active. After the additional time lag for the sensor read window the output rung consisting of input sequence 147 and output sequence 172 is implemented by activation ef internal value 820 in response to the activation of internal value 903. The next rung 148, 173 illustrates that internal value 903 will remain active as long as external input value 003 is not active.

Next, the procedures and associated ladder diagram rungs relating to the detection and indication of an improper paper count will be described. The rung for actuating the LO/HI error indicator embodied by indicator bulb 68 comprises the input sequences 143, 144 or 145 and the output sequence 170. Referring to input sequence 143, if the output of transducer 20 or 110 is past a certain threshold input value 002 will become activated. If external input value 002 is active, internal value 800 is active and internal value 820 is not active then external output 011 will become active and thereby actuate relay 60 which in turn will actuate indicator bulb 68. External output 011 will remain activated if activated when external input 003 corresponding to a new compression cycle is activated. Input sequence 145 indicates that output value 011 will remain active also if internal value 810 is active which is indicative of an error count exceeding the preset limit, 810 also deactivates the programmable controller 70 cycle by deactivating output 710.

Value 800 represents a display hold internal value. As shown in input sequence 149 when internal value 800 is active, external output value 013 will be active as shown by output sequence 174. Additionally, this display hold value 013 will be maintained active as long as the compression cycle external input value 003 is active as illustrated by input sequence 150.

Normally, the counters 54 and 55 count the number of bundles which are verified as having the correct count and the number of bundles which have an incorrect count. An active external output value 011 will initiate the inhibition of the counter which counts the number of good bundles as illustrated by the rung comprising input sequence 151 and output sequence 175. Input sequence 152 and output sequence 176 illustrate how the good bundle counter is incremented. Input sequence 152 activates the counter signal having value 014 if the time delay for the sensor read is complete as indicated by active internal value 820 and a new cylinder activation output 012 is active.

Every time external output value 011 is activated a count is incremented as represented by input sequence 154 and output sequence 178. Output sequence 178 shows that internal value 902 becomes active after three counts or activations of external output value 011. After the count of bad bundles has reached 3, a malfunction is judged to have occurred and the system is shut down. In this malfunction state internal value 902 remains active and its activation maintains internal value 810 active as illustrated by input sequence 155 and output sequence 179. As discussed previously, activation of internal value 810 will also maintain LO/HI indicator value 011 active. The system can be reset by activating the manual button 79.

In the newspaper industry it is sometimes necessary to produce stacks of newspapers which have a non-standard number of newspapers. These non-standard or odd count stacks would induce the present invention to detect a deviation in the count of these stacks from the first stack or standard stacks number of articles. Yet there is still a correct number of newspaper in the odd count stack. Therefore, in accordance with the invention, there has been provided optical detection means for detecting a change of appearance in the stack. Accordingly, the invention has means for selectively changing the appearance of the first article in a stack chosen from said plurality of stacks. As embodied herein, this describes the practice of placing a separate sheet indicative of the odd count bundle on the top of the odd count bundle. This sheet placed on top of the odd count stack changes the appearance of the stack to optical detection means attached to ram 26 or 104.

The optical detectors 122 and 124 are conventional fiber optic sensors. The white sheet produces a higher intensity optical signal than the signal detected from a printed newspaper.

In accordance with the invention there are means responsive to said optical detection means for rendering said indicating means inoperative when said change of appearance is detected. As embodied herein these means responsive to the optical detection means are the controller 70 in combination with the other control hardware. The output or outputs of the optical detector is sent to programmable controller 70. Although one optical sensor will sense the difference between the odd count sheet and the newsprint, often times one optical sensor will measure the intensity of a portion of a newspaper which has no printing on it. Two sensors serve the purpose of eliminating this occurrence since it is highly unlikely that both sensors will be directed towards portions of a newspaper which do not have newsprint.

It is contemplated that the optical sensors 122 and 124 may be mounted on either ram end 28 or ram 104. The transducers should be positioned so they may detect the reflected light intensity from the top sheet of paper on the stack being verified.

The outputs of the optical sensors activate external odd count inputs to programmable controller 70. Referring to FIG. 7, the odd count external input values are 006 and 007. The implementation of the utilization of odd count sensors 122 and 124 is illustrated in the ladder diagram of FIGS. 8A and 8B. The rung having input sequence 134 and output sequence 162 represents the initiation of the odd count bundle processing. Input sequence 134 activates output sequence 162 if both optical sensors having input values of 006 and 007 are active. Output sequence 162 delays odd count processing for a period of time to allow the sensor readings from optical sensors 122 and 124 to stabilize. Once the time delay has been satisfied and both input values 006 and 007 are active, then internal value 905 will become active. If an odd count is detected then the counting steps will be bypassed as shown by input sequence 139 and output sequence 166. This rung represents a jump to the ladder rung illustrated by input sequence 153 and output sequence 177.

It will be apparent to those skilled in the art that various modifications, variations and additions can be made in the bundle count verifier of the present invention without departing from the scope or spirit of the invention. Thus, it is intended that the present invention cover the modifications and variations of this invention provided they come within the scope of the appended claims and their equivalents.

What is claimed is:

1. An apparatus for determining respective deviations in the total number of signatures in each of a plurality of individual successive stacks from a given number of signatures, comprising:

means for compressing a plurality of individual stacks of signatures including a standard stack having said given number of signatures in succession to a predetermined pressure;

means for detecting variations between the height of said compressed standard stack and the height of each individual successive compressed stack; and means responsive to the detected variations for indicating a number of signatures in each of said successive stacks different from said standard stack.

2. An apparatus according to claim 1, wherein the means for compressing a plurality of individual stacks comprises a strapping machine having a ram for fixedly securing the stacked signatures in each of the plurality of stacks of signatures in succession.

3. An apparatus according to claim 2, wherein the strapping machine ram is comprised of a vertically movable substantially horizontally disposed bar supported at opposite ends thereof.

4. An apparatus according to claim 2, wherein said strapping machine includes a cable drive for operating said ram to compress each of said plurality of individual stacks coupled to said means responsive to the detected variations and wherein said means responsive to the detected variations includes a transducer for monitoring changes in position of the cable during compression of said standard stack having a first number of articles to said cable's position during compression of said plurality of individual successive stacks of flat articles.

5. An apparatus according to claim 4, wherein said transducer includes means for producing a plurality of successive outputs proportional to successive differences in position of the belt between when said first stack of said plurality of successive stacks with a first number of articles is compressed and when each of said plurality of individual successive stacks are compressed, respectively.

6. An apparatus according to claim 1, wherein compressing means includes a ram and wherein said means for detecting variations includes a transducer operative to monitor the position of said ram while compressing each of said plurality of individual succesive stacks.

7. An apparatus according to claim 6 wherein the ram is pneumatically driven.

8. An apparatus according to claim 1, further comprising:

means for selectively changing the appearance of the first signature in a stack chosen from said plurality of stacks;

optical detection means for detecting said change of appearance; and means responsive to said optical detection means for rendering said indicating means inoperative when said change of appearance is detected.

9. An apparatus for strapping a stack of signatures, comprising:

a ram for compressing a plurality of individual stacks of signatures in succession to a predetermined pressure;

a cable drive operatively coupled to said ram for operating said ram;

strapping means for fixedly securing the stacked signatures in each of said plurality of stacks of signatures; and means responsive to the position of said cable drive for determining respective deviations in the total number of signatures in each of said plurality of individual successive stacks from a given number of signatures.

10. An apparatus according to claim 9, wherein said means for determining respective deviations comprises:

means for detecting variations between the height of said compressed standard stack and the height of each individual successive compressed stack; and means responsive to the detected variations for indicating a number of signatures in each of said successive stacks different from said standard stack.

11. An apparatus according to claim 10, wherein said means for detecting variations includes a transducer for monitoring changes in position of the cable during compression of said standard stack having a first number of articles to said cable's position during compression of said plurality of individual successive stacks of flat articles.

12. An apparatus according to claim 11, wherein said transducer produces an output representative of a magnitude of said change in position.

13. An apparatus according to claim 12, wherein said transducer is a linear voltage displacement transducer.

14. A method of determining a deviation in the total number of signatures in a stack from a given number of signatures, comprising the steps of:

stacking a given number of the signatures in a standard stack having said given number of signatures;

compressing the standard stack to a predetermined pressure;

measuring the height of the compressed standard stack;

compressing a next stack of the signatures to the predetermined pressure; and detecting the deviation from the given number of signatures in the standard stack as a function of the height of said next stack relative to the height of the standard stack.

15. Method according to claim 14 further comprising the steps of:

compressing each stack in a plurality of successive stacks of the signatures to the predetermined pressure;

detecting each deviation from the given number of signatures in the standard stack as a function of the height of each stack in said plurality of successive stacks relative to the height of the standard stack, respectively; and counting each deviation detected.

16. A method according to claim 15 further comprising the step of comparing the counted deviations and indicating a malfunction in response to said deviation count exceeding a predetermined count.

* * * * *